US006955121B2

(12) United States Patent
Perault et al.

(10) Patent No.: US 6,955,121 B2
(45) Date of Patent: Oct. 18, 2005

(54) METHODS AND APPARATUS FOR CLEANING A STENCIL

(75) Inventors: Joseph A. Perault, Natick, MA (US); William Russell Claiborne, Worcester, MA (US)

(73) Assignee: Speedline Technologies, Inc., Franklin, MA (US)

( * ) Notice: Subject to any disclaimer, the term of this patent is extended or adjusted under 35 U.S.C. 154(b) by 0 days.

(21) Appl. No.: 10/784,123

(22) Filed: Feb. 20, 2004

(65) Prior Publication Data

US 2005/0183594 A1 Aug. 25, 2005

(51) Int. Cl.[7] ..... B41M 1/12; B41F 35/00; A46B 15/00

(52) U.S. Cl. ..... 101/129; 101/424; 101/425; 101/483; 15/256.51; 15/256.52

(58) Field of Search ..... 347/104, 2; 400/691, 400/692; 101/129, 424, 425, 483; 15/256.51, 15/256.52

(56) References Cited

U.S. PATENT DOCUMENTS 5,918,544 A 7/1999 Doyle
5,976,269 A 11/1999 Hamasaki et al.
6,036,787 A * 3/2000 Bennett et al. ..... 134/21
6,584,897 B2 * 7/2003 Cobbley et al. ..... 101/127
6,626,106 B2 9/2003 Peckham et al.

FOREIGN PATENT DOCUMENTS

EP 1 361 058 A2 11/2003
JP 2000 153602 A 6/2000

OTHER PUBLICATIONS

International Search Report for PCT/US2005/004659 mailed Jun. 20, 2005.

* cited by examiner

*Primary Examiner*—Andrew H. Hirshfeld
*Assistant Examiner*—Marvin P. Crenshaw
(74) *Attorney, Agent, or Firm*—Lowrie, Lando & Anastasi, LLP

(57) ABSTRACT

A stencil wiper apparatus for wiping a stencil of a stencil printer includes a material supply assembly having a supply roller to deliver a roll of material, a take-up roller to receive the material, and a drive to move the material across the stencil between the supply roller and the take-up roller. The apparatus further includes a fluid delivery assembly to wet the material. The fluid delivery assembly includes an outer tube, an inner tube and a fluid delivery source. The outer tube is designed to engage the material and to deliver fluid to the material. The inner tube is positioned within the outer tube, and designed to deliver fluid to the outer tube. The fluid delivery source delivers fluid to the inner tube. A method for wiping a stencil of a printing machine is further disclosed.

17 Claims, 5 Drawing Sheets

METHODS AND APPARATUS FOR CLEANING A STENCIL

RELATED APPLICATIONS

This application relates to U.S. patent application Ser. No. 10/784,121 entitled SELF-CONTAINED VACUUM MODULE FOR STENCIL WIPER ASSEMBLY by Joseph Perault and William Claiborne, filed on even date herewith, and U.S. patent application Ser. No. 10/784,122 entitled METHODS AND APPARATUS FOR CHANGING WEB MATERIAL IN A STENCIL PRINTER by Joseph Perault, Randy Peckham, Gary Freeman and Frank Marszalkowski, filed on even date herewith. Both of these related applications are incorporated herein by reference.

BACKGROUND OF INVENTION

1. Field of Invention

The present invention relates generally to stencil cleaning methods and apparatus, and more particularly to a stencil cleaning apparatus that consistently and evenly applies a fluid, such as solvent, on a web material prior to the web material being placed in a position to clean the stencil.

2. Discussion of Related Art

In a typical surface-mount circuit board manufacturing operation, a stencil printer is used to print solder paste onto a circuit board having a pattern of pads or some other conductive surface onto which solder paste will be deposited. The circuit board is automatically fed into the stencil printer and one or more small holes or marks on the circuit board, called fiducials, is used to properly align the circuit board with the stencil or screen of the stencil printer prior to the printing of solder paste onto the circuit board. Once a circuit board has been properly aligned with the stencil in the printer, the circuit board is raised to the stencil, solder paste is dispensed onto the stencil, and a wiper blade (or squeegee) traverses the stencil to force the solder paste through apertures formed in the stencil and onto the board. As the squeegee is moved across the stencil, the solder paste tends to roll in front of the blade, which desirably causes mixing and shearing of the solder paste so as to attain desired viscosity to facilitate filling of the apertures in the screen or stencil. The solder paste is typically dispensed onto the stencil from a standard cartridge.

In some prior art stencil printers, any excess solder paste remaining under the squeegee after it has fully traversed the stencil remains on the stencil when the squeegee is returned to its initial position for printing on a second circuit board. Usually, as the squeegee passes the solder paste over the stencil, minute amounts of solder paste seep through the apertures to accumulate at the bottom side of the stencil. This presents various problems, such as the solder paste being inadvertently disposed on the unintended areas of the circuit boards. Also, as the solder paste hardens, it complicates the alignment procedure of a circuit board with the stencil. Therefore, it is highly desirable to remove the excess solder paste that forms on the bottom of the stencil.

U.S. Pat. No. 5,918,544 to Doyle represents one prior art stencil printer having a well-known method and apparatus for cleaning the bottom of the stencil. Doyle discloses a wiping system that is positioned near the vicinity of the stencil and moves beneath the stencil from one end of the stencil to the other end. As the stencil wiper system moves beneath the stencil, it wipes off excess solder paste at the bottom of the stencil.

Specifically, the stencil wiper system includes a paper supply roller containing a roll of paper, a take-up roller, a pair of paper guide rollers, a hollow solvent tube with numerous small openings formed along the length of the tube, and a vacuum plenum for removing excess moisture and hardened solder paste from the paper as it travels underneath the stencil. During a cleaning operation, a paper winder motor rotates the take-up roller to draw paper from the paper supply roller, which passes paper through the pair of paper guide rollers. The hollow solvent tube is located between the paper guide rollers and is filled with solvent by a solvent pump, which causes the solvent tube to squirt solvent through its numerous holes onto the paper as it passes the solvent tube. The solvent impregnated paper is passed to the vacuum plenum, which holds the paper in place as the stencil moves over the paper, thereby cleaning the stencil.

A disadvantage to the system described in Doyle is that solvent may be applied to the paper in an inconsistent and uneven fashion. Specifically, since the pressure of the solvent closer to the solvent source, which is typically introduced at one end of the solvent tube, is far greater than the pressure at the other (opposite) end of the solvent tube, the solvent has a tendency to more completely impregnate the paper closer to the solvent source and barely wet the paper at the other end of the solvent tube. The result is that the more fully solvent impregnated portion of the paper cleans the stencil more effectively than the portion of the paper having less solvent. Another result is that too much solvent may be delivered to the portion of paper close to the solvent source thereby resulting in an excessive amount of solvent being applied to the stencil.

SUMMARY OF INVENTION

Embodiments of the invention provide improvements to stencil cleaning apparatus, such as those described above.

A first aspect of the invention is directed to a stencil wiper apparatus for wiping a stencil of a stencil printer. The apparatus includes a material supply assembly having a supply roller to deliver a roll of material, a take-up roller to receive the material, and a drive to move the material across the stencil between the supply roller and the take-up roller. The apparatus further includes a fluid delivery assembly to wet the material. The fluid delivery assembly includes: an outer tube constructed and arranged to engage the material and to deliver fluid to the material; an inner tube positioned within the outer tube, the inner tube being constructed and arranged to deliver fluid to the outer tube; and a fluid delivery source to deliver fluid to the inner tube.

In another aspect of the present invention, the outer tube has a length and a plurality of openings positioned along the length of the outer tube to wet the material along the width of the material. The inner tube has a length and a plurality of openings positioned along the length of the inner tube. The openings of the outer tube are formed in the outer tube in a position proximate to the material as material engages the outer tube. The openings of the inner tube are formed in the inner tube in a position generally opposite the plurality of openings of the outer tube.

In another aspect of the invention, the apparatus further includes a wiper blade assembly spaced between the fluid delivery assembly and the take-up roller of the material supply assembly. The wiper blade assembly moves the material between a first position in which the material is spaced away from the stencil and a second position in which the material engages the stencil.

In still another aspect of the present invention, a method for wiping a stencil of a printing machine includes: (a) delivering a roll of material having a width across the stencil; (b) evenly applying fluid on the material across the width of the material; and (c) placing the material in a position proximate to the stencil.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
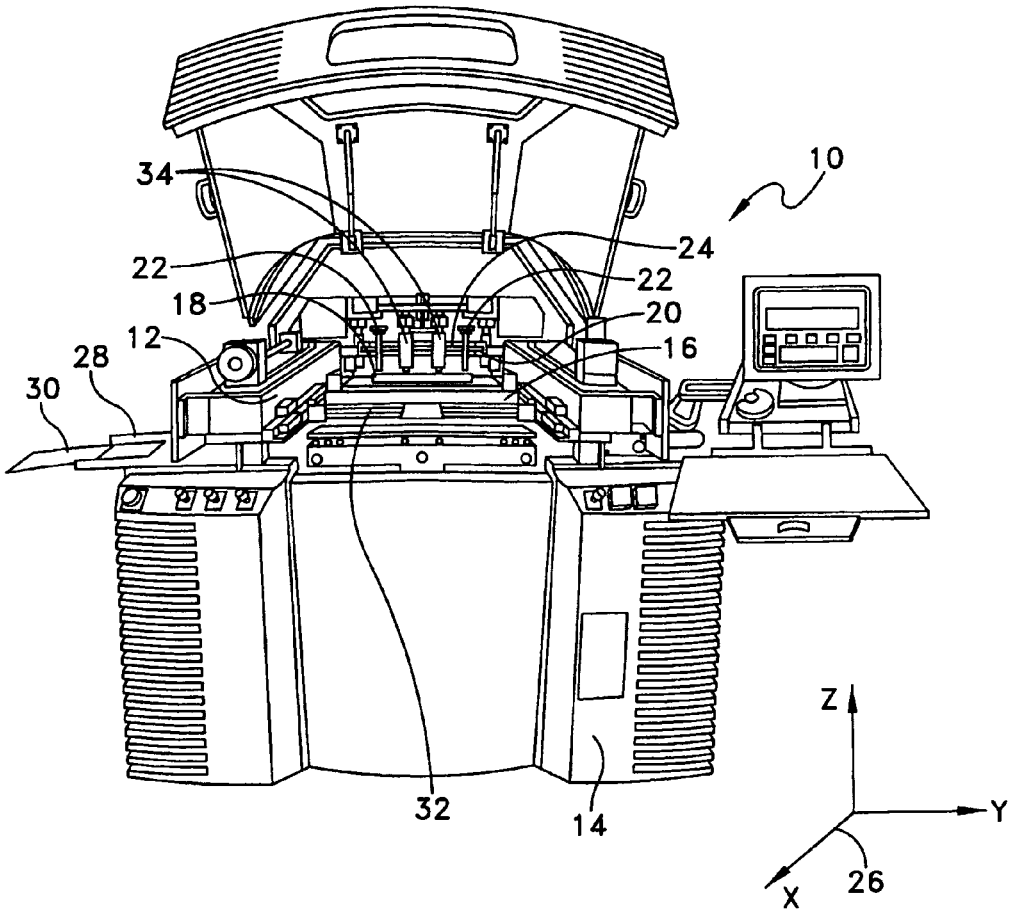
FIG. 1 shows a front elevational view of a stencil printer in which an embodiment of the present invention is implemented.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

For purposes of illustration, embodiments of the present invention will now be described with reference to a stencil printer used to print solder paste onto a circuit board. One skilled in the art will appreciate, however, that embodiments of the present invention are not limited to stencil printers that print solder paste onto circuit boards, but rather, may be used in other applications requiring dispensing of other viscous materials such as glues and encapsulents. Further, stencil printers in accordance with embodiments of the present invention are not limited to those that print solder paste on circuit boards, but rather, include those used for printing other materials on a variety of substrates. Also, the terms "screen" and "stencil" may be used interchangeably herein to describe a device in a printer that defines a pattern to be printed onto a substrate.

FIG. 1 shows a stencil printer, generally indicated at 10, in accordance with the present invention. The stencil printer 10 includes a frame 12 that supports components of the stencil printer 10 including a controller 14, a stencil 16, and a dispensing head 18 having a dispensing slot from which solder paste may be dispensed. The dispensing head 18 is coupled to a first plate 20 using two thumbscrews, each indicated at 22. The first plate 20 is coupled to a second plate 24 which is coupled to the frame 12 of the stencil printer 10. The first plate 20 is coupled to the second plate 24 in such a manner that the first plate 20 can be moved with respect to the second plate 24 along a z axis, the z axis being defined by the coordinate axis system 26. The first plate 20 is moved by motors under the control of the controller 14.

The second plate 24 is movably coupled to the frame 12 such that the second plate 24 can move with respect to the frame 12 along an x axis, the x axis also being defined by the coordinate axis system 26. As described below in further detail, the movements of the first and second plates 20, 24 allow the dispensing head 18 to be placed over the stencil 16 and moved across the stencil 16 to allow printing of solder paste onto a circuit board.

Stencil printer 10 also includes a conveyor system having rails 28 for transporting a circuit board 30 to a printing position in the stencil printer 10. The stencil printer 10 has a number of pins 32 positioned beneath the circuit board 30 when the circuit board is in the dispensing position. The pins 32 are used to raise the circuit board 30 off of the rails 28 to place the circuit board in contact with, or in close proximity to, the stencil 16 when printing is to occur.

The dispensing head 18 is configured to receive two standard three ounce or six ounce solder paste cartridges 34 that provide solder paste to the dispensing head 18 during a printing operation. Each of the solder paste cartridges 34 is coupled to one end of a pneumatic air hose. As readily understood by those skilled in the art, the dispensing head 18 could be adapted to receive other standard, or non-standard, cartridges. The other end of each of the pneumatic air hoses is attached to a compressor that under the control of the controller 14 provides pressurized air to the cartridges 34 to force solder paste to flow from the cartridges into the dispense head 18 and onto the stencil 16. Mechanical devices, such as piston, may be used in addition to, or in place of, air pressure to force the solder paste from the cartridges into the dispensing head. The controller 14 is implemented using a personal computer having a Microsoft DOS or Windows NT operating system with application specific software to control the operation of the stencil printer 10.

The stencil printer 10 operates as follows. A circuit board 30 is loaded into the stencil printer 10 using the conveyor rails 28. The dispensing head 18 is then lowered in the z direction until it is in contact with the stencil 16. Pressurized air is provided to the cartridges 34 while the dispensing head 18 is moved in the x direction across the stencil 16. The pressurized air forces solder paste out the cartridges 34 and creates pressure on the solder paste in the dispensing head 18 forcing solder paste from the dispensing slot of the dispensing head through apertures in the stencil 16 and onto the circuit board 30. Once the dispensing head 18 has fully traversed the stencil 16, the circuit board 30 is lowered back onto the conveyor rails 28 and transported from the printer 10 so that a second circuit board may be loaded into the printer. To print on the second circuit board, the dispensing head 18 is moved across the stencil 16 in the direction opposite to that used for the first circuit board. Alternatively, a squeegee arm could swing in to contain the solder paste in the dispenser 18, and the dispenser 18 can then be lifted in the z direction and moved back to its original position to prepare to print on the second circuit board using a similar direction stroke.

Figure 2:
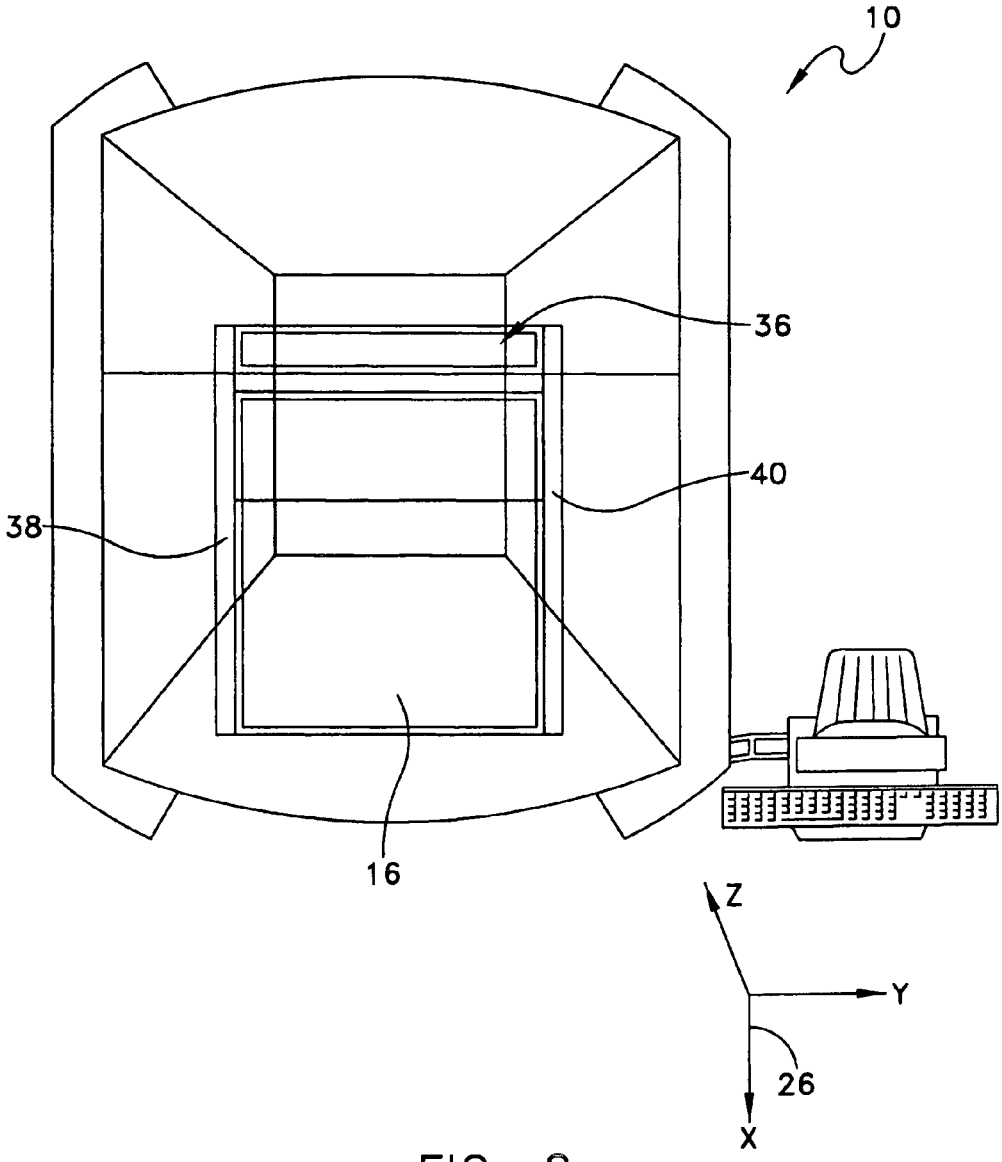
FIG. 2 shows a top plan view of the stencil printer illustrated in FIG. 1 showing a stencil wiper apparatus in accordance with an embodiment of the present invention.

After one or more applications of the solder paste to the circuit boards 30, excess solder paste accumulates at the bottom of the stencil and a stencil wiper apparatus, generally indicated at 36, of the present invention moves beneath the stencil 16 to remove the excess solder paste. FIG. 2 is a top view of the stencil printer 10 shown in FIG. 1 showing the stencil wiper apparatus 36, which is mounted on a pair of rails 38, 40 and situated at one end of the stencil 16. According to one embodiment of the invention, the stencil wiper apparatus 36 rides on linear rails 38, 40 and is moved back and forth using a rack and pinion mechanism. Alternatively, a motor and belt, mechanism may be used to reciprocate the stencil wiper apparatus 36, as well as chain and pulley linear motor, or by an alternative mechanism. The stencil wiper apparatus 36 may also stay stationary as the stencil is moved over the mechanism to perform the cleaning operation.

Figure 3:
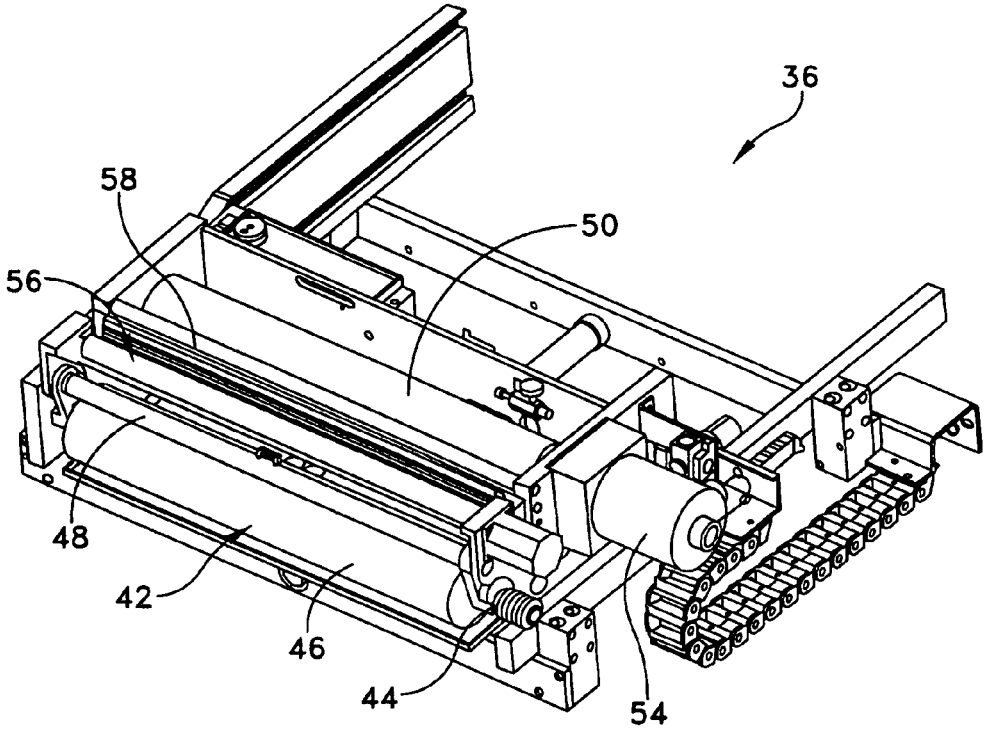
FIG. 3 shows a perspective view of the stencil wiper apparatus.
Figure 5:
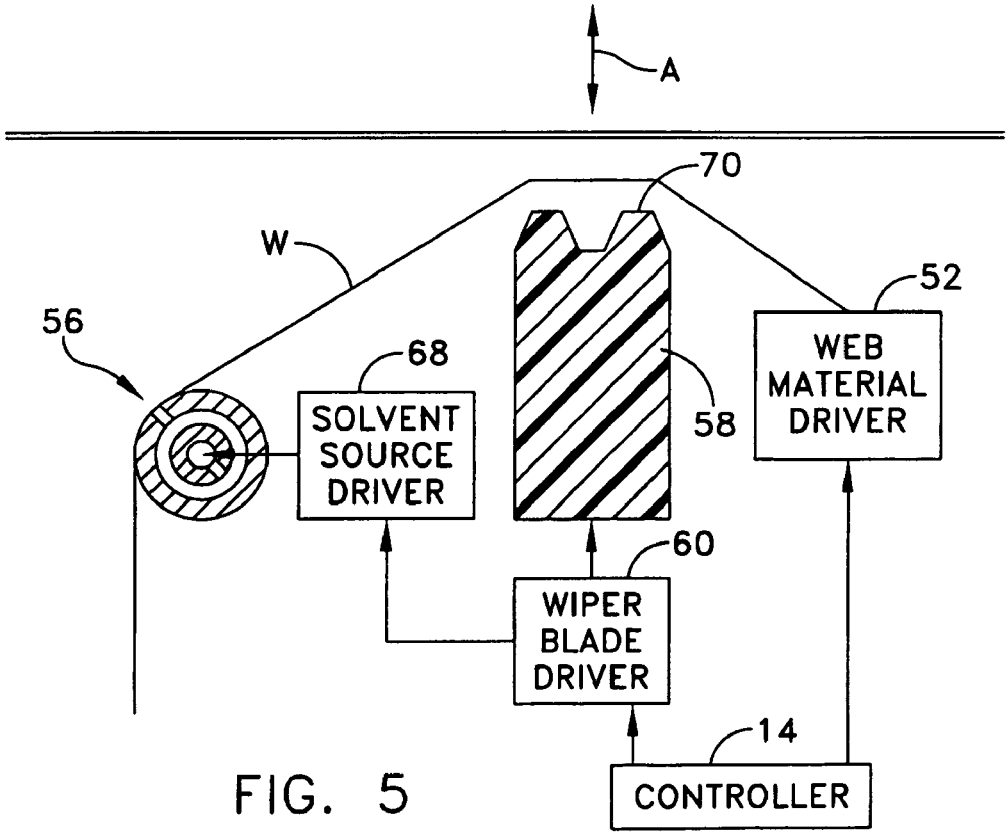
FIG. 5 shows a diagrammatic representation of the stencil wiper apparatus in accordance with an embodiment of the present invention.

Turning now to FIGS. 3 and 5, a paper supply assembly, generally indicated at 42, of the stencil wiper apparatus 36, includes a supply roller 44 having a roll of paper 46 housed thereon, at least one paper guide roller 48, a take-up roller 50 for receiving used paper, and a paper driver 52 (schematically shown in FIG. 5) having a web material winder motor 54 for moving the paper across the stencil 16 in a linear direction from the supply roller 44 to the take-up roller 50. A more detailed description of the operation of the supply roller 44, take-up roller 50 and driver 52 can be found in the related application entitled METHODS AND APPARATUS FOR CHANGING WEB MATERIAL IN A STENCIL PRINTER.

The stencil wiper apparatus 36 further includes a fluid delivery assembly, generally indicated at 56, and a wiper blade assembly 58 having a vacuum plenum for removing excess moisture and hardened solder paste from the paper as it travels underneath the stencil 16. A wiper blade driver 60 of the wiper blade assembly 58 moves the web W between a first position in which the paper is spaced away from the stencil to a second position in which the paper engages the stencil. Arrow A in FIG. 5 depicts the movement of the wiper blade assembly 58 between its first and second positions. It should be noted that in FIG. 3 the web of paper is not shown as it extends from the supply roller 44, over the guide roller 48, fluid delivery assembly 56, wiper blade assembly 58, to the take-up roller 50, so as to more clearly illustrate these components.

During a cleaning operation, the paper winder motor 54 of the web material driver 52 rotates the paper supply roller 44, which passes paper over the guide roller 48. Between the paper guide roller 48 and the take-up roller 50, there is the fluid delivery assembly 56 that is filled with solvent by a solvent pump, which is constructed to squirt solvent onto the paper as it passes over the fluid delivery assembly 56. The solvent impregnated paper is passed to the wiper blade assembly 58, which holds the paper in place as the stencil 16 moves over the paper, thereby cleaning the stencil.

Figure 4:
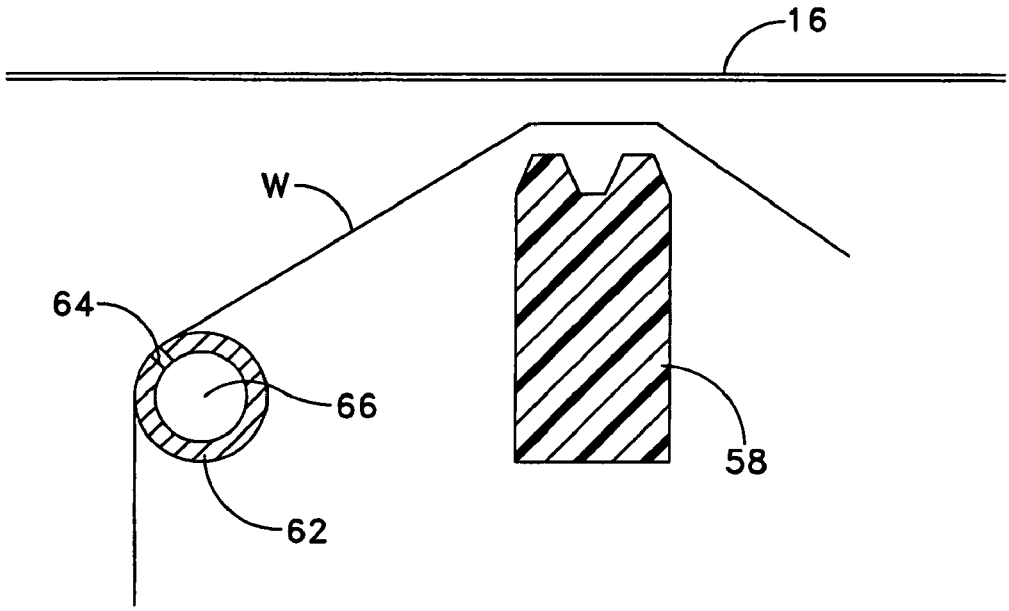
FIG. 4 (PRIOR ART)
FIG. 4 shows a diagrammatic representation of a prior art stencil wiper apparatus.

FIG. 4 illustrates a prior art solvent tube 62. As shown, the solvent tube 62 is a hollow tube having a plurality of small openings 64 formed therein along the length of the tube. The arrangement is such that solvent under pressure is delivered to the central hollow region 66 of the tube 62 from a solvent source located at one end of the tube. Since the solvent is delivered to the tube 62 at the end of the tube, maintaining consistent and even solvent pressure along the length of the tube is difficult. Such prior art solvent tubes can experience the problem of overly wetting the web material proximate to the solvent source and insufficiently wetting the paper at the end opposite the solvent source.

The fluid delivery assembly 56 of the present invention is designed specifically for consistently and evenly wetting the paper. As shown in FIG. 5, a solvent source 68, which typically includes a solvent pump (not shown) furnishes solvent or an equivalent cleaner under pressure to the fluid delivery assembly 56 in response to control signals received from the controller 14. The fluid delivery assembly 56 extends in a direction transverse with respect to the direction of the web W as it travels across the stencil 16 between the supply roller 44 and the take-up roller 50. The solvent cleaner can be chosen from a number of solvents that are well-known in the art. As will be described in greater detail herein, the fluid delivery assembly 56 is constructed and arranged for delivering solvent to the web of paper W in a more consistent and even manner than the prior art solvent tube 62 illustrated in FIG. 4.

After wetting the paper, a wiper blade 70 of the wiper blade assembly 58 engages the wetted paper to clean the underside of the stencil 16. The vacuum plenum of the wiper blade assembly 58 removes particles from the web of paper W so as not to contaminate the printing operation. A more detailed description of the vacuum plenum can be found in the related application entitled SELF-CONTAINED VACUUM MODULE FOR STENCIL WIPER ASSEMBLY. The wiper blade driver 60 extends and retracts the wiper blade 70 between the second and first positions in response to control signals from the controller 14. The web material driver 52 advances the web of paper W from left to right (as shown in FIG. 5) in response to control signals received from the controller 14 to move the paper across the wiper blade 70.

Referring specifically to FIG. 5, the controller 14 sends signals to the solvent source 68 to deliver solvent to the fluid delivery assembly 56. The controller 14 also delivers control signals to the wiper blade driver 60 to selectively press or engage the web of paper W against the bottom surface of the stencil 16 and to the web material driver 52 to effect movement of the paper from left to right when cleaning is desired. The web of paper W continuously moves with the wiper blade 70 urging the web W against the bottom surface of the stencil 16. The controller furnishes control signals to the solvent source 68 to effect the termination of delivery of solvent to the fluid delivery assembly 56 when it is desired to clean the stencil with dry paper.

Figure 7:
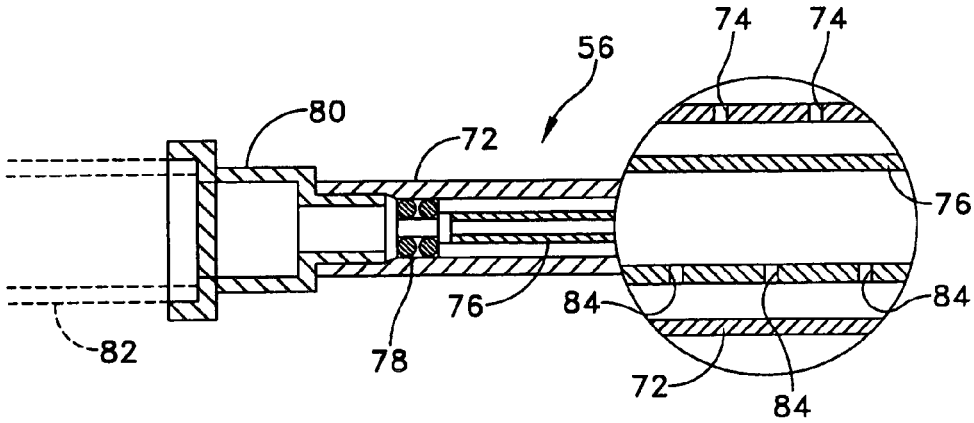
FIG. 7 shows an enlarged, lengthwise cross-sectional view of the fluid delivery system shown in FIG. 6.
Figure 6:
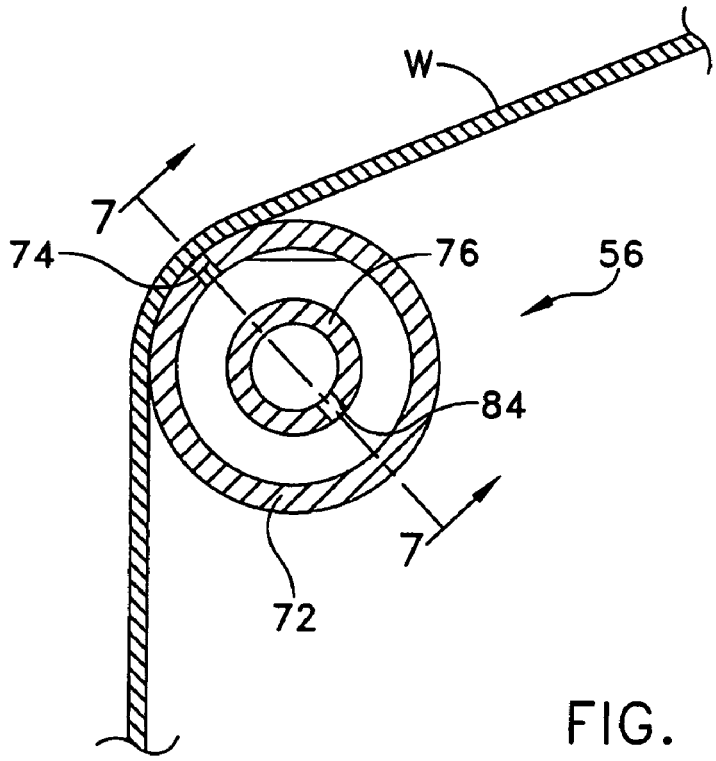
FIG. 6 shows an enlarged diagrammatic representation of a fluid delivery system of the stencil wiper apparatus in accordance with an embodiment of the present invention.

Referring to now FIGS. 6 and 7, and more particularly to FIG. 6, the fluid delivery assembly 56 includes an outer tube 72 oriented to engage the web of paper W and constructed to deliver solvent to the web of paper. Preferable the outer tube 72 is fabricated out of any suitable metal, such as stainless steel, bronze, or the like, that is resistant to the corrosive nature of solvents. Alternatively, the outer tube 72 can be fabricated out of a polymeric material that is also resistant to solvents. As shown, the outer tube 72 has a plurality of relatively small openings 74 formed therein along the length of the outer tube 72 for delivering solvent to the entire width of the web of paper. Solvent within the outer tube 72 is evenly pressurized to squirt out of the outer tube 72 and onto the web of paper W. As the web of paper W rides over the outer tube 72, the paper wicks the solvent as it is delivered by the solvent source 68. Provided within the outer tube 72 is an inner tube 76 constructed from the same material as the outer tube 72 and suitably secured therein so that the inner tube 76 extends concentrically within the outer tube 72 substantially along its entire length.

FIG. 7 illustrates a seal 78 provided for securing an end of the inner tube 76 to the end of the outer tube 72 so that the inner tube is suspended centrally within the outer tube. The opposite end of the inner tube 76 is supported by another seal 78 in an identical manner to that of the end shown in FIG. 7. It should be understood that the inner tube 76 can be secured to the outer tube 72 within the outer tube in any suitable manner, and that it is not a requirement that the inner tube 76 be concentrically positioned within the outer tube 72 so long as the purposes of the present invention are achieved. A fitting 80 connects the outer tube 72 of the fluid delivery assembly 56 to the solvent source 68 via line 82.

The solvent source 68 delivers solvent to the inner tube 76 of the fluid delivery assembly 56. The solvent captured within the inner tube 76 escapes through a plurality of relatively small openings 84 formed along the length of the inner tube 76. As illustrated in FIG. 6, the openings 84 of the inner tube 76 are positioned generally opposite to the openings 74 of the outer tube 72. This construction allows for solvent to enter into the bottom of the outer tube 72, thereby filling the outer tube 72 evenly from the bottom to the top prior to the solvent reaching the openings 74 of the outer tube. Specifically, solvent that is delivered to the inner tube 76 escapes the inner tube via the openings 84 to fill the outer tube 72 from the bottom to the top. The differential of pressure of the solvent within the inner tube 76 is normalized as the solvent is delivered to the outer tube 72 since solvent fills the outer tube 72 evenly along its length. Thus, the pressure of solvent at each of the openings 74 of the outer tube 72 is substantially equal.

Figure 8:
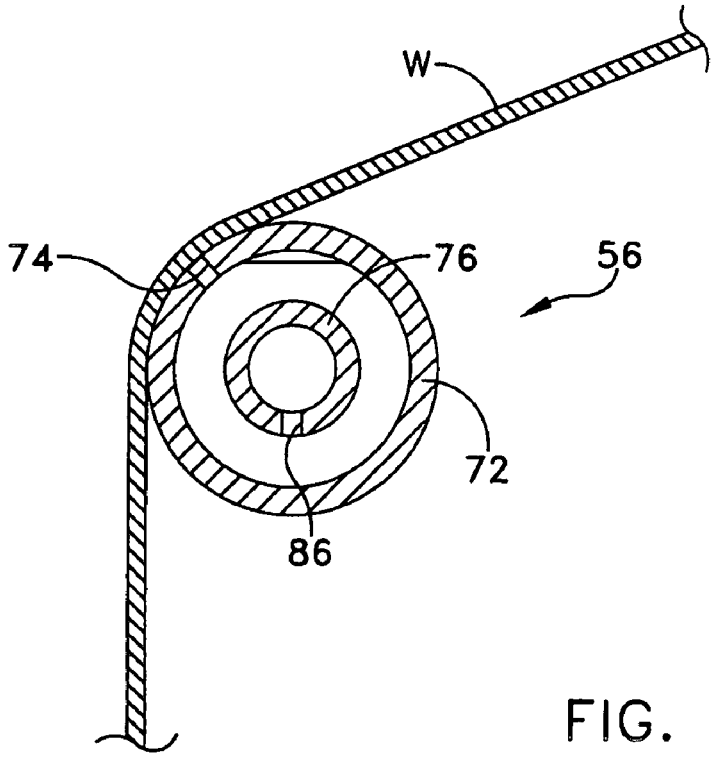
FIG. 8 shows an enlarged diagrammatic representation of a fluid delivery system of the stencil wiper apparatus in accordance with another embodiment of the present invention.

FIG. 8 illustrates an alternate embodiment of the inventions showing the plurality of openings 86 of the inner tube 76 extending generally in a downward direction thereby still achieving the purpose of the present invention of normalizing pressure within the outer tube 72.

The operation of the stencil wiper apparatus 36 is as follows. The stencil wiper apparatus 36 (or the stencil 16, as the case may be) is brought into position so that the stencil wiper apparatus 36 can clean the underneath of the stencil 16. The controller 14 activates the web material driver 52 to move the web of paper W across the outer solvent tube 72 of the fluid delivery assembly 56 and the wiper blade assembly 58. Simultaneously, the controller 14 activates the solvent source 68 to deliver solvent to the web of paper W (via the inner tube 76 to the outer tube 72) and activates the wiper blade driver 60 to engage the wiper blade 70 of the wiper blade assembly 58 against the web of paper W and stencil 16. The stencil wiper apparatus 36 is moved across the underneath of the stencil 16 to effect cleaning of the stencil. Alternatively, the stencil 16 can be moved across the stencil wiper apparatus 36. Excess material wiped away from the stencil 16 is removed by the vacuum plenum of the wiper blade assembly 58. The stencil wiper apparatus 36 of the present invention is far more effective in cleaning the underneath of the stencil in that solvent is applied to the web of paper W more evenly than with prior art fluid delivery assemblies.

The improved stencil wiper apparatus 36 of the present invention is particularly adaptive in retrofitting existing prior art solvent tubes that require replacement due to their ineffectiveness in evenly wetting the paper. Specifically, by simply replacing the solvent tube, such as the solvent tube 62 illustrated in FIG. 4, with the fluid delivery assembly 56 of the present invention, the problems described above are easily cured.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A stencil wiper apparatus for wiping a stencil of a stencil printer, the apparatus comprising:

a material supply assembly including a supply roller to deliver a roll of material, a take-up roller to receive the material, and a drive to move the material across the stencil between the supply roller and the take-up roller; and a fluid delivery assembly to wet the material, said fluid delivery assembly including an outer tube constructed and arranged to engage the material and to deliver fluid to the material, an inner tube positioned within the outer tube, the inner tube being constructed and arranged to deliver fluid to the outer tube, and a fluid delivery source to deliver fluid to the inner tube.

2. The stencil wiper apparatus set forth in claim 1, the outer tube having a length and a plurality of openings positioned along the length of the outer tube to wet the material along the width of the material.

3. The stencil wiper apparatus set forth in claim 2, the inner tube having a length and a plurality of openings positioned along the length of the inner tube.

4. The stencil wiper apparatus set forth in claim 3, said plurality of openings of the outer tube being formed in the outer tube in a position proximate to the material as material engages the outer tube.

5. The stencil wiper apparatus set forth in claim 4, said plurality of openings of the inner tube being formed in the inner tube in a position generally opposite the plurality of openings of the outer tube.

6. The stencil wiper apparatus set forth in claim 1 further comprising a wiper blade assembly spaced between the fluid delivery assembly and the take-up roller of the material supply assembly, the wiper blade assembly moving the material between a first position in which the material is spaced away from the stencil and a second position in which the material engages the stencil.

7. A stencil wiper apparatus for wiping a stencil of a stencil printer, the apparatus comprising:

a material supply assembly to deliver material across the stencil; and means for evenly applying a fluid on the material prior to the material being placed in a position proximate to the stencil, where said means for evenly applying a fluid comprises an outer tube constructed and arranged to engage the material and to deliver fluid to the material, an inner tube positioned within the outer tube, the inner tube being constructed and arranged to deliver fluid to the outer tube and a fluid delivery source to deliver fluid to the inner tube.

8. The stencil wiper apparatus set forth in claim 7, the material supply assembly including a supply roller to deliver a roll of material, a take-up roller to receive the material, and a drive to move the material across the stencil between the supply roller and the delivery roller.

9. The stencil wiper apparatus set forth in claim 7, the outer tube having a length and a plurality of openings positioned along the length of the outer tube to wet the material along the width of the material.

10. The stencil wiper apparatus set forth in claim 9, the inner tube having a length and a plurality of openings positioned along the length of the inner tube.

11. The stencil wiper apparatus set forth in claim 10, said plurality of openings of the outer tube being formed in the outer tube in a position proximate to the material as material engages the outer tube.

12. The stencil wiper apparatus set forth in claim 11, said plurality of openings of the inner tube being formed in the inner tube in a position generally opposite the plurality of openings of the outer tube.

13. The stencil wiper apparatus set forth in claim 7 further comprising wiper blade means to move the material between a first position in which the material is spaced away from the stencil and a second position in which the material engages the stencil.

14. A method for wiping a stencil of a printing machine comprising:

(a) delivering a roll of material having a width across the stencil;

(b) evenly applying fluid on the material across the width of the material; and (c) placing the material in a position proximate to the stencil, providing said step of evenly applying fluid on the material comprises providing an outer tube constructed and arranged to engage the material and to deliver fluid to the material, providing an inner tube positioned within the outer tube, the inner tube being constructed and arranged to deliver fluid to the outer tube and delivering fluid to the inner tube.

15. The method set forth in claim 14 further comprising moving the material between a first position in which the material is spaced away from the stencil and a second position in which the material engages the stencil.

16. The method set forth in claim 15 further comprising applying fluid across the width of material from a plurality openings, with a fluid pressure of the fluid at each opening being approximately equal.

17. A stencil printer comprising:

a stencil;

a material applicator to apply material on the stencil; and a stencil wiper assembly to selectively wipe the stencil, the stencil wiper assembly having a paper supply assembly, and a fluid delivery assembly to wet the paper, the fluid delivery assembly including an outer tube constructed and arranged to engage the paper and to deliver fluid to the paper, an inner tube positioned within the outer tube, the inner tube being constructed and arranged to deliver fluid to the outer tube, and a fluid delivery source to deliver fluid to the inner tube.

* * * * *